US009757776B2

(12) United States Patent
Nikic

(10) Patent No.: US 9,757,776 B2
(45) Date of Patent: Sep. 12, 2017

(54) CLEARING OF APERTURES BY PLASMA JETS

(71) Applicant: The Boeing Company, Chicago, IL (US)

(72) Inventor: Dejan Nikic, Seattle, WA (US)

(73) Assignee: The Boeing Company, Chicago, IL (US)

( * ) Notice: Subject to any disclaimer, the term of this patent is extended or adjusted under 35 U.S.C. 154(b) by 231 days.

(21) Appl. No.: 14/516,247

(22) Filed: Oct. 16, 2014

(65) Prior Publication Data

US 2016/0107203 A1 Apr. 21, 2016

(51) Int. Cl.

| | |
|---|---|
| ***B08B 7/00*** | (2006.01) |
| ***B08B 9/00*** | (2006.01) |
| ***H05H 1/48*** | (2006.01) |
| ***H05H 1/24*** | (2006.01) |

(52) U.S. Cl.
CPC ..... *B08B 7/0035* (2013.01); *H05H 1/24* (2013.01); *H05H 1/48* (2013.01)

(58) Field of Classification Search
CPC ..... B08B 7/0035; B64D 15/14; H05H 1/24
See application file for complete search history.

(56) References Cited

U.S. PATENT DOCUMENTS

| | | | | |
|---|---|---|---|---|
| 3,683,212 | A | 8/1972 | Zoltan | |
| 3,853,730 | A | 12/1974 | Anderson | |
| 5,322,985 | A * | 6/1994 | Ohba | B23K 10/00 216/67 |
| 5,590,854 | A * | 1/1997 | Shatz | B64C 1/12 244/130 |
| 5,858,108 | A | 1/1999 | Hwang | |
| 6,075,321 | A | 6/2000 | Hruby | |
| 6,412,732 | B1 | 7/2002 | Amitay et al. | |
| 6,964,470 | B2 | 11/2005 | Kagami | |
| 7,866,609 | B2 | 1/2011 | Parikh | |
| 8,127,037 | B2 | 2/2012 | Koehler | |
| 8,245,976 | B2 | 8/2012 | Sakurai et al. | |
| 8,337,629 | B2 | 12/2012 | Moriya et al. | |
| 9,637,224 | B2 | 5/2017 | Nikic | |
| 2003/0155467 | A1* | 8/2003 | Petrenko | A63C 1/30 244/134 R |
| 2006/0131282 | A1 | 6/2006 | Miller et al. | |

(Continued)

FOREIGN PATENT DOCUMENTS

| | | |
|---|---|---|
| EP | 1038677 | 9/2000 |
| EP | 2913266 | 9/2015 |

(Continued)

OTHER PUBLICATIONS

United States Patent and Trademark Office, "Advisory Action," issued in connection with U.S. Appl. No. 14/186,760, mailed on Jul. 21, 2016, 4 pages.

(Continued)

*Primary Examiner* — Michael Kornakov
*Assistant Examiner* — Natasha Campbell
(74) *Attorney, Agent, or Firm* — Hanley, Flight & Zimmerman, LLC

(57) ABSTRACT

Clearing of apertures by plasma jets is described herein. One disclosed method includes applying a pulsed voltage to electrodes proximate an aperture of a surface to substantially clear the aperture of debris.

14 Claims, 6 Drawing Sheets

(56) References Cited

U.S. PATENT DOCUMENTS

| | | | | |
|---|---|---|---|---|
| 2007/0089795 | A1 | 4/2007 | Jacob | |
| 2008/0023589 | A1* | 1/2008 | Miles | B64C 23/005 244/205 |
| 2010/0051242 | A1 | 3/2010 | Arik et al. | |
| 2010/0133386 | A1 | 6/2010 | Schwimley et al. | |
| 2010/0229952 | A1 | 9/2010 | Smith et al. | |
| 2011/0089835 | A1 | 4/2011 | Miller et al. | |
| 2011/0253842 | A1 | 10/2011 | Silkey et al. | |
| 2015/0083866 | A1 | 3/2015 | Biedscheid | |
| 2015/0239552 | A1 | 8/2015 | Nikic | |

FOREIGN PATENT DOCUMENTS

| | | |
|---|---|---|
| FR | 2955628 | 7/2011 |
| WO | 2011004124 | 1/2011 |

OTHER PUBLICATIONS

Schoenbach et al., "Microhollow Cathode Discharges," App. Phys. Lett. 68 (1), Jan. 1, 1996, American Institute of Physics, 3 pages.
Shin et al., "Exhaust Plume Characteristics of Microhollow Cathode Discharge Plasma Thruster," IEEE Transactions on Plasma Science, vol. 39, No. 11, Nov. 2011, 2 pages.
Xia et al., "Experimental Investigation of Microhollow Cathode Discharge for the Application to Microplasma Thrusters," Tsinghua Science and Technology, Dec. 2009, vol. 14—No. S2, Tsinghua University, China, 5 pages.
United States Patent and Trademark Office, "Final Office Action," issued in connection with U.S. Appl. No. 14/186,760, mailed on May 12, 2016, 15 pages.
Shin et al., "Exhaust Plume Characteristics of Microhollow Cathode Discharge Plasma Thruster," IEEE Transactions on Plasma Science, Nov. 9, 2011, vol. 39, No. 11, 2 pages.
Schoenbach et al., "Microhollow Cathode Discharges," Appl. Phys. Lett. 68 (1), Jan. 1, 1996, American Institute of Physics, 3 pages.
European Patent Office, "European Search Report", issued in connection with EP Application No. 14195327.1, ssued on Jul. 13, 2015, 2 pages.
United States Patent and Trademark Office, "Non-Final Office Action", issued in connection with U.S. Appl. No. 14/186,760, mailed on Nov. 25, 2015, 28 pages.
United States Patent and Trademark Office, "Restriction Requirement", issued in connection with U.S. Appl. No. 14/186,760, mailed on Jul. 14, 2015, 6 pages.
United States Patent and Trademark Office, "Notice of Allowance," issued in connection with U.S. Appl. No. 14/186,760, mailed on Dec. 15, 2016, 24 pages.

* cited by examiner

CLEARING OF APERTURES BY PLASMA JETS

RELATED APPLICATION

The subject matter of this patent relates to U.S. patent application Ser. No. 14/186,760 titled "PLASMA-ASSISTED SYNTHETIC JETS FOR ACTIVE AIR FLOW CONTROL" filed on Feb. 21, 2014, which is hereby incorporated by reference in its entirety.

FIELD OF THE DISCLOSURE

This patent relates generally to plasma jets and, more particularly, to clearing of apertures by plasma jets.

BACKGROUND

Some aircraft utilize different devices and/or systems that require external apertures of the aircraft. One example is a Pitot tube used to measure an airspeed of the aircraft based on air pressure that surrounds the aircraft. Another example of external apertures is perforations on an aerodynamic surface of a hybrid laminar flow control system, which is used to reduce the overall drag coefficient of an aircraft.

Typically, apertures positioned on an external surface of an aircraft are subject to debris, ice and/or others that can contaminate, block or partially block the apertures. These blockages may result in reduced performance of aircraft systems and/or impact sensors or other measuring devices utilizing the apertures. Often, the apertures may require manual clearing and/or regular maintenance to maintain the apertures relatively free from debris obstruction and/or blocking.

SUMMARY

An example method includes applying a pulsed voltage to electrodes proximate an aperture of an external surface to substantially clear the aperture of debris.

An example apparatus includes electrodes proximate an aperture of an external surface, and a voltage source to supply a pulsed voltage to the electrodes to generate a plasma jet to substantially clear the aperture.

Another example method includes generating a plasma jet to substantially clear an external aperture of debris.

Figure 1:
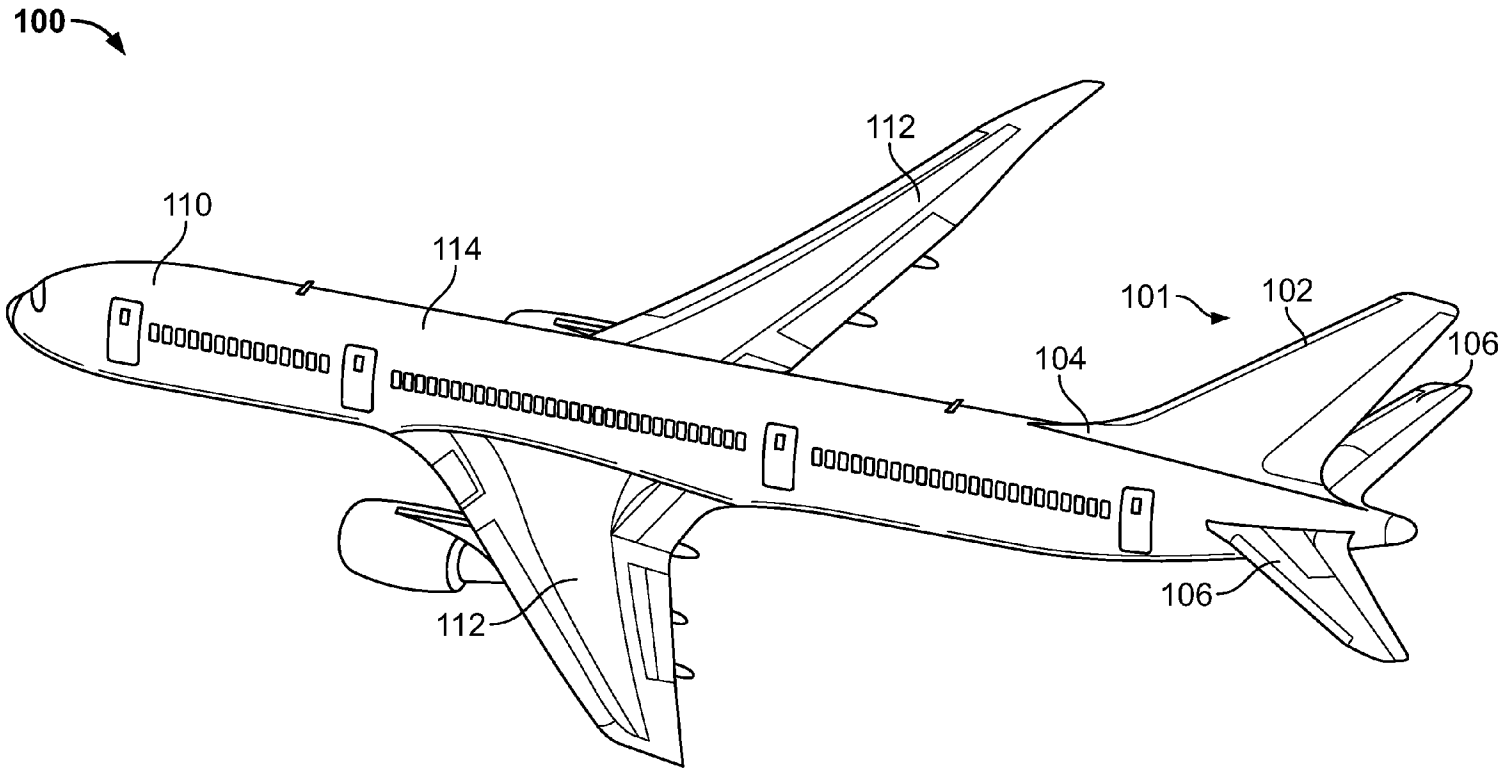
FIG. 1 illustrates an example aircraft that may be used to implement the example methods and apparatus disclosed herein.

Wherever possible, the same reference numbers will be used throughout the drawing(s) and accompanying written description to refer to the same or like parts. As used in this disclosure, stating that any part is in any way positioned on (e.g., positioned on, located on, disposed on, or formed on, etc.) another part, means that the referenced part is either in contact with the other part, or that the referenced part is above the other part with one or more intermediate part(s) located therebetween. Stating that any part is in contact with another part means that there is no intermediate part between the two parts.

DETAILED DESCRIPTION

Clearing of apertures by plasma jets is disclosed herein. Exposure of an aircraft to external conditions and/or normal use may result in external openings or apertures of the aircraft trapping and/or accumulating debris, ice and/or other matter. This accumulation in the apertures may result in reduced performance of an aircraft device (e.g., a laminar flow control system) and/or inaccurate aircraft measurements of measuring devices utilizing the apertures. In particular, a Pitot tube, which determines the air speed of the aircraft based on air pressure around the aircraft, may have an exposed opening used for measurements that may be susceptible to trapping and/or accumulating debris or ice, which may lower the accuracy of pressure measurements made at the Pitot tube by altering the pressure of air at the exposed opening. The examples disclosed herein may be used for apertures (e.g., holes) of an active flow control system such as those described in U.S. patent application Ser. No. 14/186,760, which is incorporated herein by reference in its entirety. In particular, the examples disclosed herein may be used in conjunction with the electrodes described in conjunction with jet actuators to clear apertures of debris.

In other examples, a laminar flow control system such as those described in U.S. Pat. Nos. 7,866,609, 8,127,037 and 8,245,976, and U.S. patent application Ser. No. 14/036,992, all of which are hereby incorporated by reference in their entireties, a fin or an outboard structure of an aircraft may have multiple perforations to draw air, thereby increasing laminar flow around the aircraft to reduce an overall drag coefficient of the aircraft during flight and/or purge the perforations during landing, for example. In particular, debris or ice trapped within one or more of the perforations may lead to reduced suction of turbulent air and, thus, a greater overall drag coefficient for the aircraft.

The examples disclosed herein may be used to clear debris from apertures such as ice from the openings (e.g., apertures) placed or positioned on external surfaces of an aircraft, for example. In particular, electrodes positioned around an aperture are supplied with a pulsed voltage that generates a plasma jet and/or a plasma shockwave near the electrodes, which substantially clears the aperture from debris, ice and/or other contaminants, etc. The examples disclosed herein may electrically couple numerous electrodes surrounding respective openings via an etching process of an external surface, for example, to simultaneously clear and/or substantially reduce the amount of debris within and/or blocking the openings (e.g., numerous electrodes surrounding different openings, and electrically coupled in parallel or series, etc.).

In some examples, a presence of debris is detected in an aperture before a pulsed voltage is applied to electrodes surrounding the aperture. In some examples, a frequency, amplitude or a waveform of the pulsed voltage is defined and/or altered by processor based on a type of debris present in the aperture, external conditions of the aircraft and/or an amount of debris present in the aperture.

As used herein, the term "pulsed voltage" may refer to a DC pulse voltage, a rectangular pulse signal, a pulse-width modulation (PWM) signal, an AC voltage signal, a pulsed AC signal, a rectified AC signal, a sinusoidal signal, any combination of the aforementioned signals, or any other appropriate signal, etc. As used herein, the term "debris" refers to debris, in general, including, but not limited to particulate, ice, contaminants, residue, and/or fluids, etc. As used herein, the term "plasma" refers to ionized fluid, ionized gas and/or ionized air, etc.

FIG. 1 illustrates an example aircraft 100 in which the examples disclosed herein may be implemented. The aircraft 100 of the illustrated example includes a tail section 101 including a vertical fin 102 adjacent to a dorsal fairing 104, horizontal stabilizers 106, a nose section (e.g., a cockpit section) 110 and wings 112 attached to a fuselage 114. The examples described herein may be applied to any of the tail section 101, the nose section 110, the stabilizers 106, the wings 112, any other exterior or outboard structure (e.g., a wing strut, an engine strut, a canard stabilizer, etc.) and/or the fuselage 114.

Figure 2A:
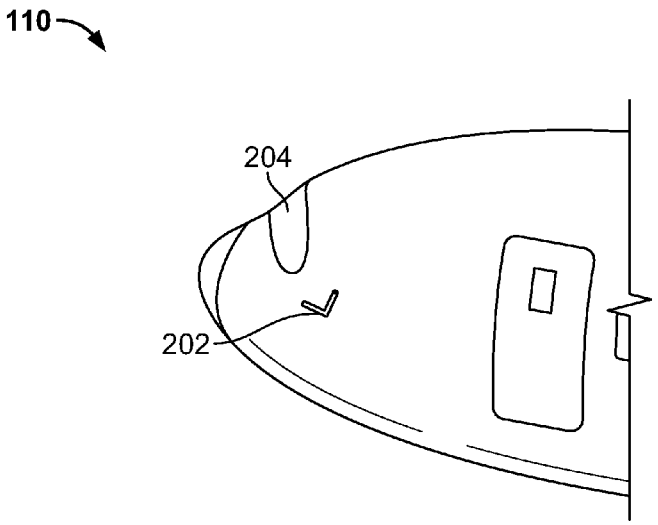
FIG. 2A is a detailed view of a nose section of the example aircraft of FIG. 1 illustrating an example Pitot tube in which the examples disclosed herein can be implemented.

FIG. 2A is a detailed view of the nose section 110 of the example aircraft 100 of FIG. 1 illustrating an example Pitot tube (e.g., a Pitot-static tube) 202, in which the examples disclosed herein can be implemented. In this example, the example Pitot tube 202 is positioned near a cockpit window 204 and used to measure air speed of the aircraft 100 by measuring a pressure differential between dynamic and static pressures. Typically, ice formation at or around openings of a Pitot tube may cause malfunction of the Pitot tube and/or inaccurate airspeed measurements. Some known Pitot tubes employ heating elements to prevent such ice formation and clogging of the tubes. However, use of the heating elements may be ineffective in removing other types of debris. Additionally, the heating elements may require a significant amount of time to melt the ice and/or remove the ice. While the Pitot tube 202 is shown in the cockpit section 110 in the illustrated example, the Pitot tube 202 may be located at any appropriate location of the aircraft 100.

Figure 2B:
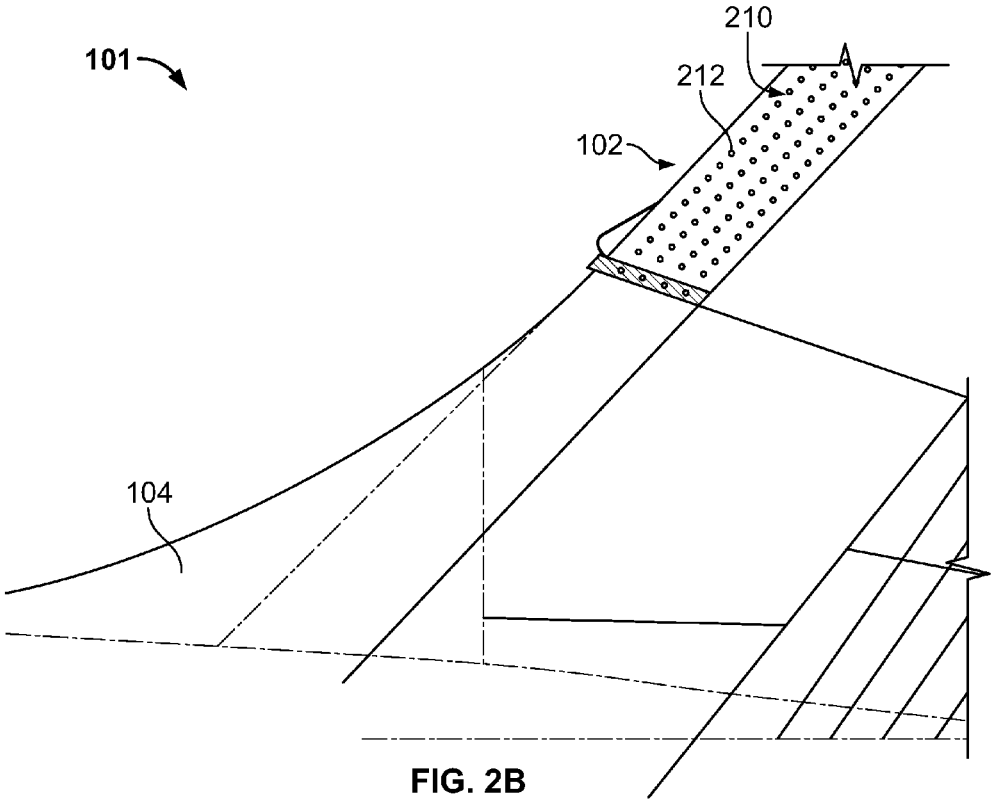
FIG. 2B is a detailed view of a tail section of the example aircraft of FIG. 1 illustrating an example fin structure in which the examples disclosed herein can be implemented.

FIG. 2B is a detailed view of the tail section 101 of the example aircraft 100 of FIG. 1 illustrating the vertical fin 102 and the dorsal fairing 104. In this example, the aircraft 101 has a laminar flow control system. In this example, the laminar flow control system located on the vertical fin 102 and/or the dorsal fairing 104 has multiple perforations 210 including an aperture 212 in which the examples disclosed herein may be implemented. Laminar flow control systems, which may be passive or active, generally use suction to draw turbulent air into an inlet via apertures and cause the air to move to an exit opening, thereby reducing the turbulence of the air adjacent to the fin which, in turn, reduces the overall drag coefficient of the aircraft. The resulting drag coefficient reduction can improve overall fuel economy of the aircraft and, thus, reduce fuel costs and carbon-dioxide ($CO_2$) emissions. Many known active laminar flow control systems employ turbo machinery or a compressor to draw turbulent air through the inlet. Passive systems, in contrast, use pressure differentials between the inlet and outlet to drive the flow of air. Some passive systems employ a door opened in a first direction to engage a suction airflow between a perforated inlet and the door. Additionally, the door may be actuated in another direction to purge the inlet by engaging a flow path between the door and the perforated surface. Some known flow control systems draw air out of the inlet.

Figure 3:
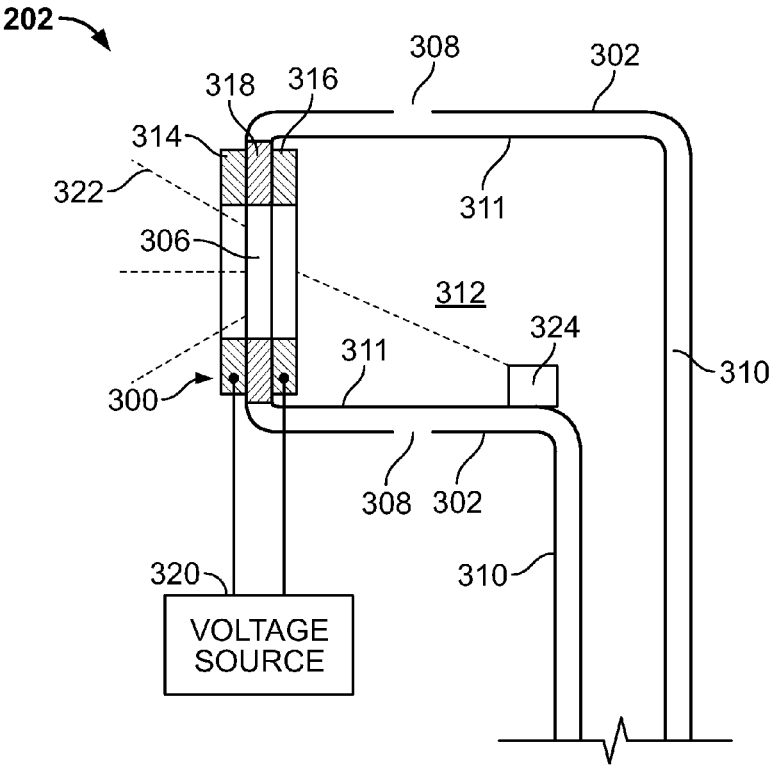
FIG. 3 is a cross-sectional view of a portion the example Pitot tube of FIG. 2A with an example plasma jet device in accordance with the teachings of this disclosure.

FIG. 3 is a cross-sectional view of a portion of the example Pitot tube 202 of FIG. 2A with an example plasma jet device 300 in accordance with the teachings of this disclosure. The Pitot tube 202 of the illustrated example includes outer walls 302 having openings (e.g., static ports, static pressure openings, etc.) 308 defining static pressure chambers 310, and a dynamic pressure aperture (e.g., an opening, an orifice, etc.) 306. The dynamic pressure aperture 306 and inner walls 311 define a dynamic internal pressure chamber 312. In this example, the example jet clearing device 300 includes an outer electrode 314, an inner electrode 316, both of which are separated by a layer 318, which may be a dielectric material or non-conductive material, and a voltage source 320. In this example, the outer electrode 314 and the inner electrode 316 are coupled, mounted, fastened and/or adhered to the layer 318, which is mounted onto a structure defined by the inner and outer walls 302, 311. In other examples, the electrodes 314, 316 may be mounted directly onto the structure defined by the inner and outer walls 302, 311 or any other appropriate structure of the Pitot tube 202. The outer electrode 314 and the inner electrode 316 of the illustrated example are comprised of molybdenum. However, any appropriate material and/or coating may be used. The outer electrode 314 and the inner electrode 316 of the illustrated example are electrically coupled (e.g., wired) to the voltage source 320, which is located in the fuselage 114, for example.

In operation, the dynamic pressure aperture 306 of the Pitot tube 202 faces in a direction generally along a direction of travel of the aircraft 100 to cause the dynamic internal pressure chamber 312 to receive airflow and/or pressurized air along the direction. In this example, the openings 308 draw static pressure to the static pressure chambers 310. A differential between the static pressure chambers 310 and the dynamic internal pressure chamber 312 is used to determine the airspeed of the aircraft 100. In particular, the measured pressure differential may be used to indicate the airspeed of the aircraft 100 to instrumentation of a cockpit of the aircraft 100.

Because of the operation of the Pitot tube in external conditions, ice and/or other debris may accumulate around or within the dynamic pressure aperture 306. Such accumulations may lead to erroneous airspeed measurements of the aircraft 100 and/or prevent measurement of the airspeed altogether. To reduce (e.g., eliminate) the amount of debris accumulated around the dynamic pressure aperture 306, the voltage source 320 of the illustrated example applies a pulsed voltage across the outer electrode 314 and the inner electrode 316 to ionize and/or cause plasma to form at or near the dynamic pressure aperture 306. In particular, the pulsed voltage applied generates a jet (e.g., a plasma jet) 322 of plasma, which may cause a resulting shockwave (e.g., a plasma shockwave) to be generated. The jet 322 reduces and/or substantially eliminates the debris present near the aperture 306.

In this example, the voltage source 320 applies a pulsed DC voltage to the electrodes 314, 316. However, the voltage source 320 may apply a signal such as a rectangular pulse signal, a square wave, a pulse-width modulated (PWM)

signal, an AC voltage signal, a pulsed AC signal, a rectified AC signal, a sinusoidal signal, any combination of the aforementioned signals, or any other appropriate signal, etc. In some examples, it has been demonstrated that a 500 microsecond (μs) DC pulse signal having an amplitude of 600 V (Volt) at 600 Amperes (Amps) may be applied at 1 second (s) intervals to effectively clear openings. In other examples, the pulse frequency may be increased to 5-10 Hertz (Hz).

In this example, the pulsed voltage is applied during flight of the aircraft 100. Additionally or alternatively, the pulsed voltage may be applied during manufacturing to clear paint and/or other debris caused by manufacturing processes and/or applied between flights of the aircraft 100. Additionally or alternatively, in yet other examples, the pulsed voltage may be applied during service or maintenance.

In some examples, an existence of debris or other buildup may be indicated by a sensor 324 electrically coupled (e.g., wired) to the voltage source 320, for example. In particular, upon detection of a presence of debris, the sensor 324 and/or a processor communicatively coupled to the voltage source 320 may cause and/or signal the voltage source 320 to apply the pulsed voltage between the outer electrode 314 and the inner electrode 316 to generate the jet 322. The sensor 324 may be an optical sensor, an infrared (IR) sensor, or any other appropriate sensor used to detect debris and/or contamination.

Figure 4:
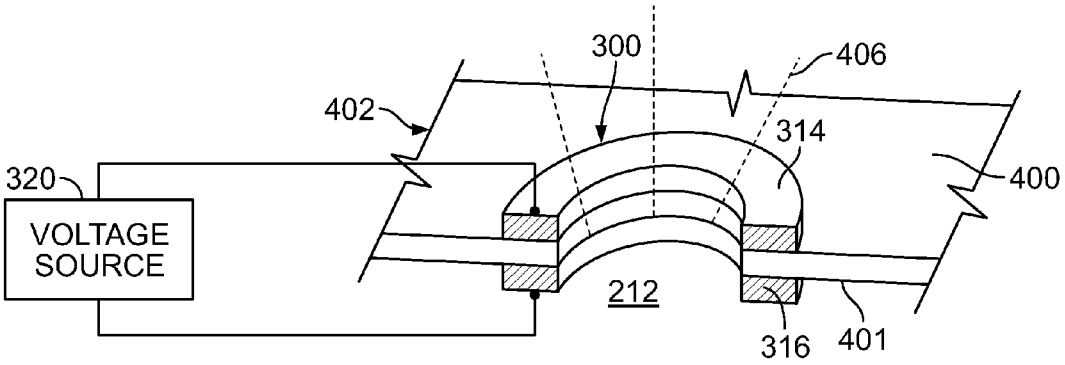
FIG. 4 is a cross-sectional view of an aperture of FIG. 2B with the example plasma jet clearing device of FIG. 3.

FIG. 4 is a cross-sectional view of the aperture 212 of FIG. 2B with the example plasma jet device 300 of FIG. 3. In this example, the outer electrode 314 and the inner electrode 316 are coupled, mounted and/or adhered to an outer face 400 and an inner face 401, respectively, of an external surface (e.g., an aerodynamic surface, a perforated surface, etc.) 402 of a laminar flow control system of the aircraft 100. In other examples, the outer and inner electrodes 314, 316 may be attached or coupled by fastening means and/or aligned by features on the external surface 402.

Similar to the operation of the example plasma jet clearing device 300 used in conjunction with the Pitot tube 202 and described above in connection with FIG. 3, a pulsed voltage is applied to the electrodes 314, 316 via the voltage source 320 to generate a jet (e.g., a plasma jet) 406, which reduces an amount of (e.g., removes) debris around or within the aperture 212, thereby allowing the hybrid laminar flow control system to operate effectively. In this example, numerous electrodes corresponding to respective apertures are electrically coupled to one or more voltage sources. In some examples, the electrodes of different apertures are electrically coupled in parallel. Alternatively, the electrodes of different apertures are electrically coupled in series. Additionally or alternatively, numerous electrodes corresponding to different apertures are independently controlled (e.g., numerous voltage sources provide pulsed voltage to different sets of electrodes at different times, etc.).

Figure 5:
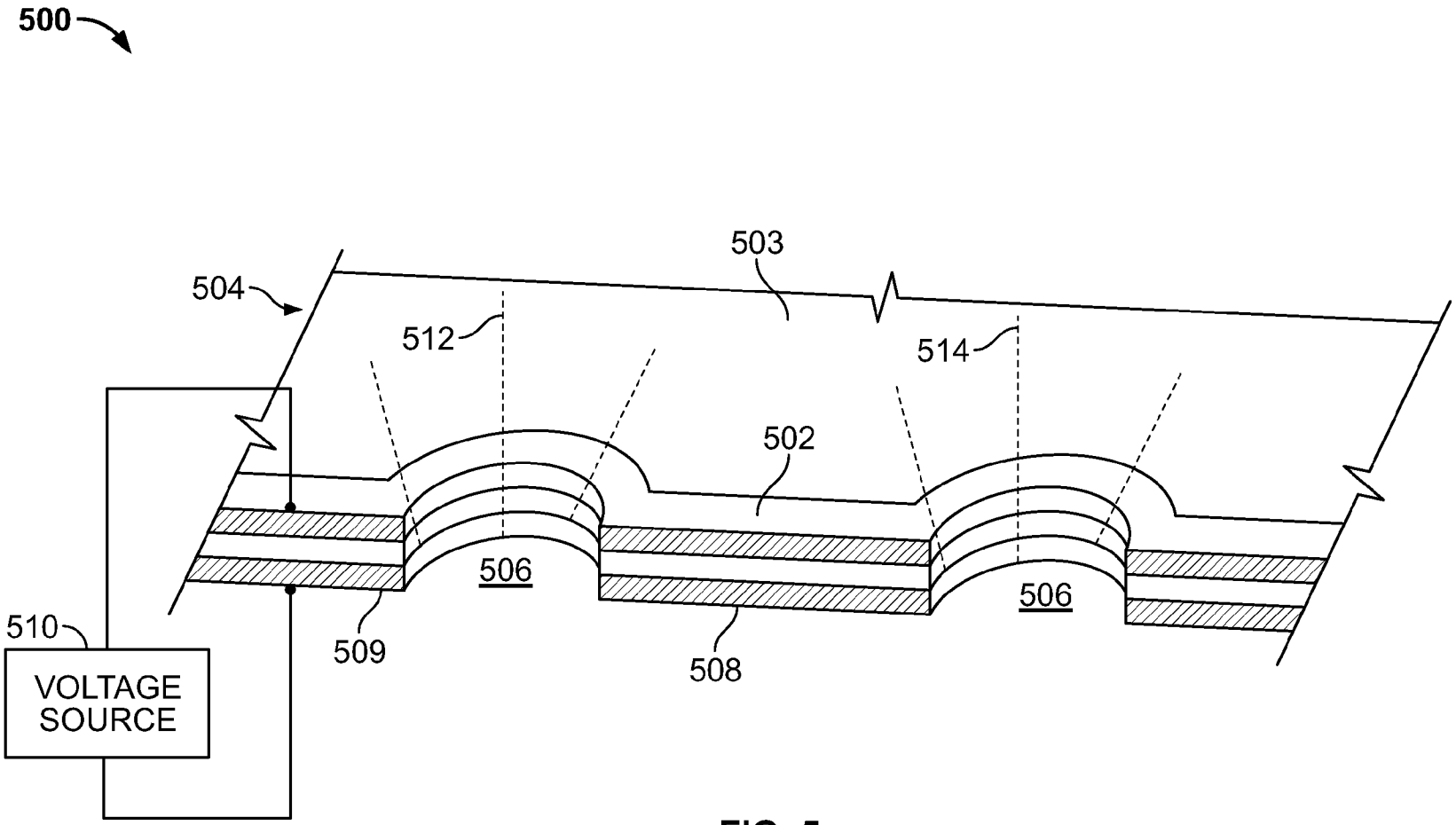
FIG. 5 is a cross-sectional view of another example plasma jet clearing device with etched electrodes.

FIG. 5 is a cross-sectional view of another example plasma jet clearing device 500 with etched electrodes for use with a laminar flow control system. The plasma jet device 500 of the illustrated example has a first etched electrode pattern 502 on an outer face 503 of an external surface 504. The first etched pattern 502 surrounds apertures 506 of the external surface 504. The plasma jet clearing device 500 of the illustrated example also has a second etched pattern 508 on an inner face 509 of the external surface 504. In this example the first and second etched patterns 502, 508 have substantially the same geometry (e.g., layout, geometric etched shape, geometric pattern, 2-D layout, etc.). The first and second etched patterns 502, 508 of the illustrated example are electrically coupled to a voltage source 510, which applies a pulsed voltage to the first and second etched patterns to generate jets (e.g., plasma jets) 512 and 514 at or near the apertures 506. In this example, the plasma jets 512 and 514 are generated simultaneously. Alternatively, in some examples, different apertures on the external surface 504 may be controlled independently (e.g., different electrode patterns and/or apertures are provided with a pulsed voltage at different times, and/or a portion of the electrode patterns are provided with a pulsed voltage, etc.). While the first etched electrode pattern 502 is shown on the external face 503 of the external surface 504, any of the first and second etched patterns 502, 508 may be embedded between layers (e.g., composite layers, etc.) of the external surface 504 and/or painted over to reduce (e.g., minimize) exposure and/or damage to the first or second etched patterns 502, 508.

In some examples, implementing an etched pattern allows for reduced manufacturing costs, reduced assembly time and/or component number reductions because placement of electrodes, wiring, and/or other components associated with the electrodes may be reduced or eliminated. In particular, implementing the etched pattern may reduce or eliminate adhering, bonding, attaching and/or assembly steps that may be necessary to assemble electrode components and/or assemblies. Further, use of the etched pattern may allow greater overall space-savings and/or weight reductions relative to placement of electrode components and/or assemblies.

Figure 6:
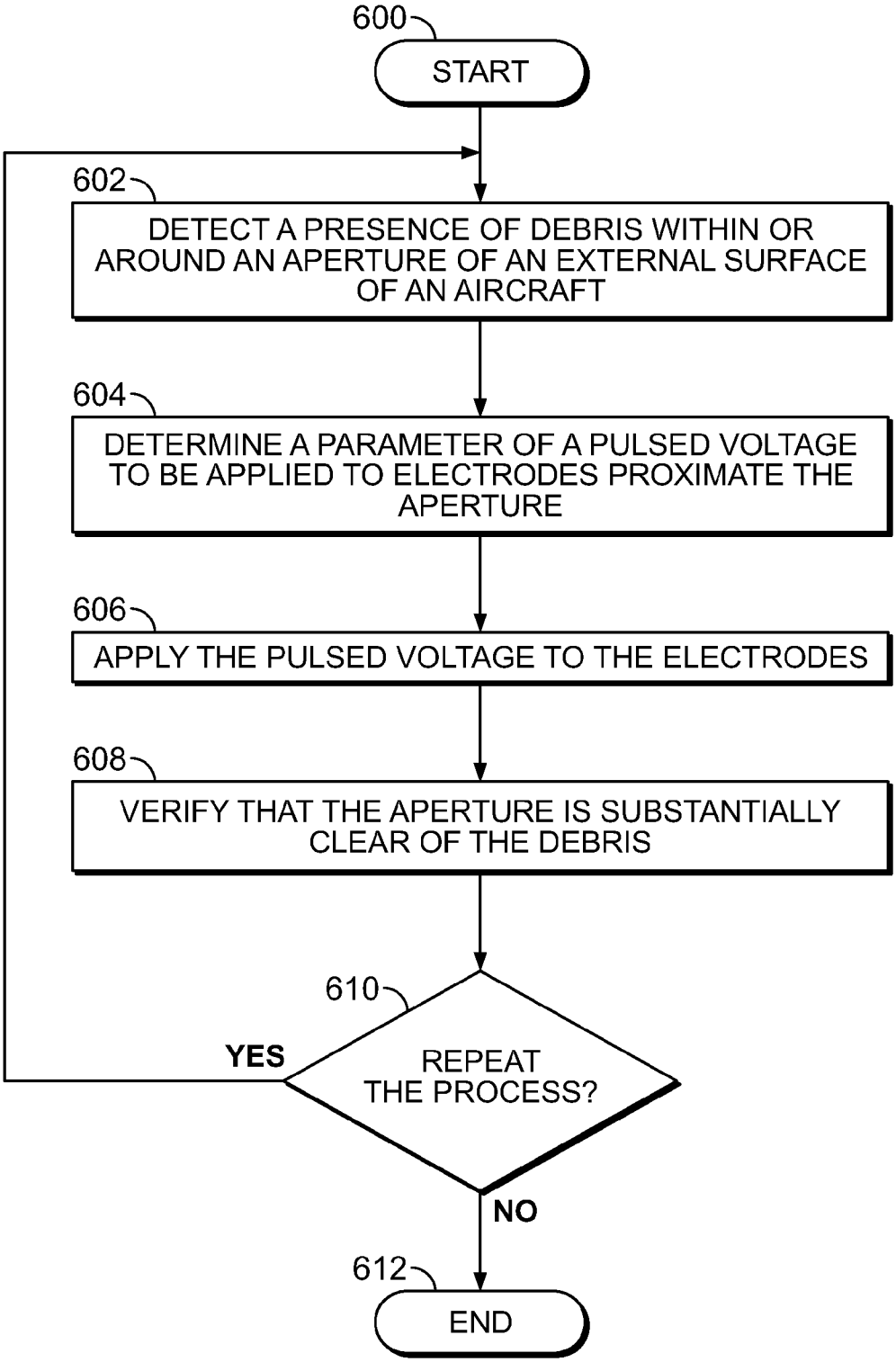
FIG. 6 is a flowchart representative of an example method that may be used to implement the plasma jet clearing devices of FIGS. 3-5.

A flowchart representative of an example method for implementing the example plasma jet devices 300, 500 described in connection with FIGS. 3-5 is shown in FIG. 6. In this example, the method may be implemented using machine readable instructions that comprise a program for execution by a processor such as the processor 712 shown in the example processor platform 700 discussed below in connection with FIG. 7. The program may be embodied in software stored on a tangible computer readable storage medium such as a CD-ROM, a floppy disk, a hard drive, a digital versatile disk (DVD), a Blu-ray disk, or a memory associated with the processor 712, but the entire program and/or parts thereof could alternatively be executed by a device other than the processor 712 and/or embodied in firmware or dedicated hardware. Further, although the example program is described with reference to the flowchart illustrated in FIG. 6, many other methods of implementing the example plasma jet devices 300, 500 of FIGS. 3-5 may alternatively be used. For example, the order of execution of the blocks may be changed, and/or some of the blocks described may be changed, eliminated, or combined.

As mentioned above, the example method of FIG. 6 may be implemented using coded instructions (e.g., computer and/or machine readable instructions) stored on a tangible computer readable storage medium such as a hard disk drive, a flash memory, a read-only memory (ROM), a compact disk (CD), a digital versatile disk (DVD), a cache, a random-access memory (RAM) and/or any other storage device or storage disk in which information is stored for any duration (e.g., for extended time periods, permanently, for brief instances, for temporarily buffering, and/or for caching of the information). As used herein, the term tangible computer readable storage medium is expressly defined to include any type of computer readable storage device and/or storage disk and to exclude propagating signals and to exclude transmission media. As used herein, "tangible computer readable storage medium" and "tangible machine readable storage medium" are used interchangeably. Additionally or alternatively, the example method of FIG. 6 may be implemented using coded instructions (e.g., computer and/or machine readable instructions) stored on a non-transitory computer and/or machine readable medium such as a hard disk drive, a flash memory, a read-only memory, a compact disk, a digital versatile disk, a cache, a random-access memory and/or any other storage device or storage disk in which information is stored for any duration (e.g., for extended time periods, permanently, for brief instances, for temporarily buffering, and/or for caching of the information). As used herein, the term non-transitory computer readable medium is expressly defined to include any type of computer readable storage device and/or storage disk and to exclude propagating signals and to exclude transmission media. As used herein, when the phrase "at least" is used as the transition term in a preamble of a claim, it is open-ended in the same manner as the term "comprising" is open ended.

The example method begins at block 600 where debris have blocked and/or entered an aperture (e.g., the aperture 212) of an external surface of an aircraft. In some examples, a sensor such as the sensor 324 described above in connection with FIG. 3 detects a presence of debris (e.g., a blockage) in the aperture (block 602) and may cause a voltage source to apply a pulsed voltage to electrodes proximate the aperture. In some examples, a processor such as the processor 712 described below in connection with FIG. 7 determines one or more parameters of a pulsed voltage to be applied to the electrodes (block 604). The parameters may include, but are not limited to, voltage, current, pulse duration, pulse frequency, and/or variation of the pulsed voltage signal over time, etc. Determination of the parameters may be based on a type of debris present, external conditions of the aircraft (e.g., temperature, pressure, altitude, airspeed, etc.), and/or an amount of debris present, etc.

Next, the pulsed voltage is applied to the electrodes via the voltage source (e.g., the voltage source 320) to generate a plasma jet to reduce the amount of debris within or around the aperture (e.g., substantially eliminate the debris within the aperture) (block 606). In some examples, the sensor detects a presence of debris during or after the pulsed voltage is applied to the electrodes (block 608) to verify that the aperture is substantially clear of the debris and/or an amount of debris detected is within a defined threshold (block 608). In some examples, based on the verification, the sensor and/or the processor signals the voltage source to cease providing the pulsed voltage to the electrodes based on detecting a reduced amount of debris and/or no detectable debris present within or around the aperture. Next, it is determined whether the process is to end (block 610). This determination may be based on the verification that the aperture is substantially clear of debris and/or a time duration of the pulsed voltage applied, etc. If the process is determined to end (block 610), the process ends (block 612). If the process is not determined to end (block 610), the process repeats (block 602).

Figure 7:
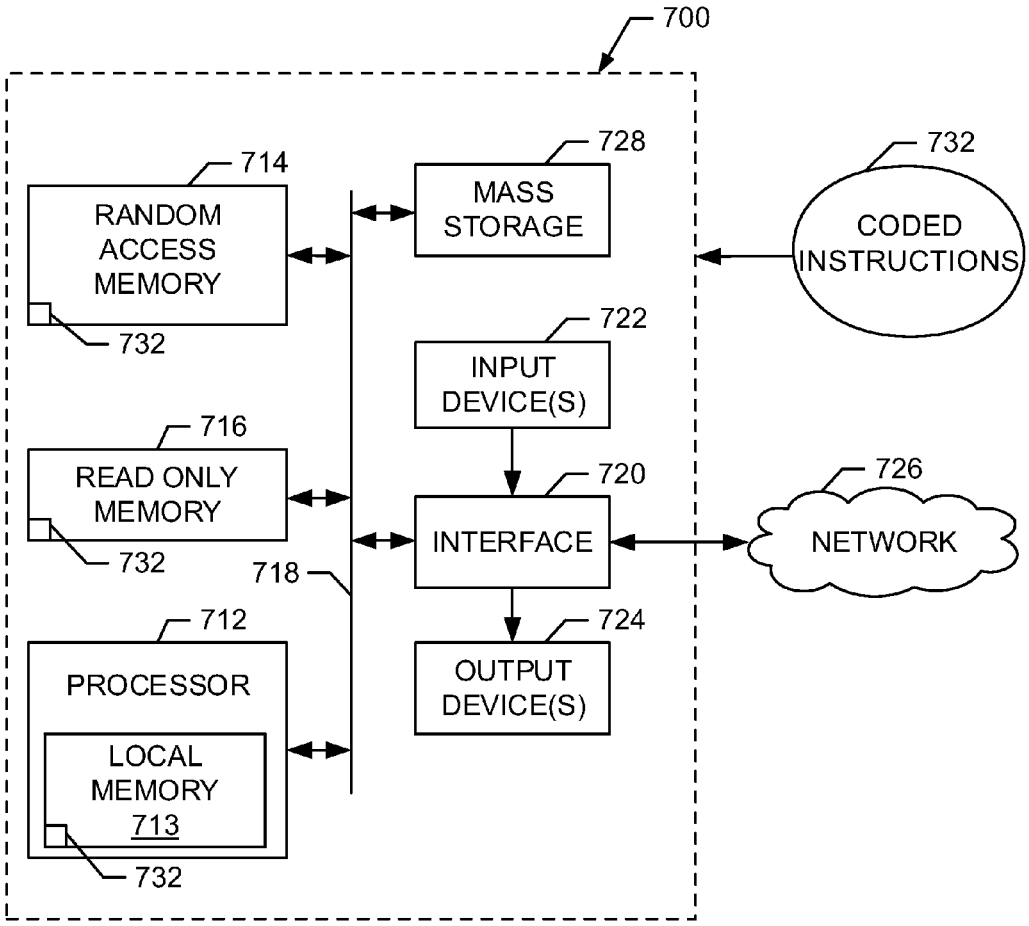
FIG. 7 is a block diagram of an example processor platform capable of executing machine readable instructions to implement the example method of FIG. 6.

FIG. 7 is a block diagram of an example processor platform capable of executing machine readable instructions to implement the example method of FIG. 6. The processor platform 700 of the illustrated example includes a processor 712. The processor 712 of the illustrated example is hardware. For example, the processor 712 can be implemented by one or more integrated circuits, logic circuits, microprocessors or controllers from any desired family or manufacturer.

The processor 712 of the illustrated example includes a local memory 713 (e.g., a cache). The processor 712 of the illustrated example is in communication with a main memory including a volatile memory 714 and a non-volatile memory 716 via a bus 718. The volatile memory 714 may be implemented by Synchronous Dynamic Random Access Memory (SDRAM), Dynamic Random Access Memory (DRAM), RAMBUS Dynamic Random Access Memory (RDRAM) and/or any other type of random access memory device. The non-volatile memory 716 may be implemented by flash memory and/or any other desired type of memory device. Access to the main memory including the volatile memory 714 and the non-volatile memory 716 is controlled by a memory controller.

The processor platform 700 of the illustrated example also includes an interface circuit 720. The interface circuit 720 may be implemented by any type of interface standard, such as an Ethernet interface, a universal serial bus (USB), and/or a PCI express interface.

In the illustrated example, one or more input devices 722 are connected to the interface circuit 720. The input device(s) 722 permit(s) a user to enter data and commands into the processor 712. The input device(s) can be implemented by, for example, an audio sensor, a microphone, a camera (still or video), a keyboard, a button, a mouse, a touchscreen, a track-pad, a trackball, isopoint and/or a voice recognition system.

One or more output devices 724 are also connected to the interface circuit 720 of the illustrated example. The output devices 724 can be implemented, for example, by display devices (e.g., a light emitting diode (LED), an organic light emitting diode (OLED), a liquid crystal display, a cathode ray tube display (CRT), a touchscreen, a tactile output device, a printer and/or speakers). The interface circuit 720 of the illustrated example, thus, typically includes a graphics driver card, a graphics driver chip or a graphics driver processor.

The interface circuit 720 of the illustrated example also includes a communication device such as a transmitter, a receiver, a transceiver, a modem and/or network interface card to facilitate exchange of data with external machines (e.g., computing devices of any kind) via a network 726 (e.g., an Ethernet connection, a coaxial cable, a cellular telephone system, etc.).

The processor platform 700 of the illustrated example also includes one or more mass storage devices 728 for storing software and/or data. Examples of such mass storage devices 728 include floppy disk drives, hard drive disks, compact disk drives, Blu-ray disk drives, RAID systems, and digital versatile disk (DVD) drives.

Coded instructions 732 to implement the methods of FIG. 6 may be stored in the mass storage device 728, in the volatile memory 714, in the non-volatile memory 716, and/or on a removable tangible computer readable storage medium such as a CD or DVD.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent. While examples related to aircraft are described, the example methods, apparatus and articles of manufacture may be applied to vehicles, aerodynamic structures, devices, etc.

What is claimed is:

1. A method comprising:

applying a pulsed voltage to first and second electrodes surrounding an aperture of an aerodynamic surface to substantially clear the aperture of debris, the first electrode disposed on an outer face of the aerodynamic surface and the second electrode disposed on an interior face of the aerodynamic surface, the first and second electrodes having respective annular ring-shaped portions surrounding the aperture, the annular ring-shaped portions each having a respective outer diameter centered on the aperture.

2. The method as defined in claim 1, wherein the aperture is part of a laminar flow control system or an active flow control system of an aircraft.

3. The method as defined in claim 1, wherein the first and second electrodes are etched onto the outer face and the inner face, respectively, of the aerodynamic surface.

4. The method as defined in claim 1, wherein the aerodynamic surface is part of an active flow control system or a laminar flow control system of an aircraft.

5. The method as defined in claim 1, wherein the aerodynamic surface is an external surface of an aircraft and pulsed voltage is applied during manufacturing or assembly of the aircraft.

6. The method as defined in claim 1, wherein the aerodynamic surface is an external surface of an aircraft, and further comprising varying a frequency or an amplitude of the pulsed voltage based on one or more of a type of debris present, external conditions of the aircraft, or an amount of debris present.

7. A method comprising:

generating a plasma jet to substantially clear an aperture of an aerodynamic surface of debris, the plasma jet generated at first and second electrodes surrounding the aperture, the first electrode disposed on an outer face of the aerodynamic surface and the second electrode disposed on an interior face of the aerodynamic surface, the first and second electrodes having respective annular ring-shaped portions surrounding the aperture, the annular ring-shaped portions each having a respective outer diameter centered on the aperture.

8. The method as defined in claim 7, wherein the aerodynamic surface is on an external surface of an aircraft and generating the plasma jet occurs during flight of the aircraft.

9. The method as defined in claim 7, wherein generating the plasma jet comprises applying a pulsed voltage to the first and second electrodes.

10. The method as defined in claim 1, wherein the first and second electrodes are defined by first and second etched patterns, respectively, of the aerodynamic surface.

11. The method as defined in claim 1, further including a non-conducting dielectric material between the first and second electrodes.

12. The method as defined in claim 1, further including detecting, via an infrared sensor, the debris in the aperture, wherein the detected debris cause the pulsed voltage to be applied.

13. The method as defined in claim 12, wherein detecting the debris includes detecting at least one of an amount or a type of the debris.

14. The method as defined in claim 12, further comprising determining a parameter of the pulsed voltage based on the detected debris.

* * * * *